United States Patent [19]

Dorawala et al.

[11] 4,298,452

[45] Nov. 3, 1981

[54] COAL LIQUEFACTION

[75] Inventors: Tansukhlal G. Dorawala; Edwin R. Kerr, both of Wappingers Falls, N.Y.

[73] Assignee: Texaco Inc., White Plains, N.Y.

[21] Appl. No.: 135,047

[22] Filed: Mar. 28, 1980

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS 2,133,280 10/1938 Burk ..... 208/8 E
2,307,675 1/1943 Hantge et al. ..... 208/8 LE
4,089,773 5/1978 Espenscheid ..... 208/8 LE
4,124,485 11/1978 Can et al. ..... 208/8 LE

FOREIGN PATENT DOCUMENTS 54-4124005 9/1979 Japan ..... 208/8 LE

*Primary Examiner*—Delbert E. Gantz
*Assistant Examiner*—William G. Wright
*Attorney, Agent, or Firm*—Carl G. Ries; Robert A. Kulason; Robert Knox, Jr.

[57] ABSTRACT

Solid fuel is liquefied at elevated temperature and pressure in the presence of a solvent, water and a material which decomposes to carbon monoxide and hydrogen.

10 Claims, No Drawings

COAL LIQUEFACTION

This invention relates to the liquefaction or dissolution of solid fuels. More particularly, it is concerned with the liquefaction of a fossil fuel such as coal in the presence of internally generated hydrogen.

In general, the dissolution or liquefaction of solid fuels is carried out in the presence of hydrogen and a solvent preferably derived from the fuel at a temperature in the range of about 700° to 850° F. and a pressure in the range of about 400 to 4000 psig. The preferred solvent is a recycled solvent boiling within the range of about 400° to 800° F. It contains sufficient amounts of di-, tri-and tetra-cyclic aromatics which can be hydrogenated in the liquefaction reactor itself or externally before being recycled to the liquefaction reactor. During liquefaction the organic portion of the coal or solid fuel becomes soluble by the transfer of hydrogen to it. The extent of the dissolution then depends on the ability of the solvent to transfer hydrogen and on the contact times in the liquefaction reactor. The processes which rely on internal hydrogenation usually operate at higher pressures in the range of 1500 to 4000 psig, whereas processes which employ external hydrogenation of the solvent operate at lower pressures in the range of about 400 to 1500 psig. In either type of liquefaction process, the kinetic steps involved in the dissolution of the fuel are: (1) transfer of hydrogen from the bulk gaseous phase to the liquid and (2) transfer of hydrogen from the liquid phase to the solid fuel.

It is, therefore, an object of this invention to convert a solid fuel into a fluid fuel. Another object is to liquefy coal in the presence of internally generated hydrogen. Still another object is to conduct the liquefaction of coal at pressures below those ordinarily used in the prior art. These, and other objects, will be obvious to those skilled in the art from the following disclosure.

According to our invention, there is provided a process for the liquefaction of a solid fuel which comprises contacting a solid fuel in finely divided form in the presence of a solvent therefor with water and materials which can decompose to hydrogen and carbon monoxide such as methanol or formaldehyde at a temperature between about 700° and 900° F. and a pressure between about 0 and 400 psig for a period of time between about 1 minute and 120 minutes.

The solid fuels which may be used as feedstock for the process of our invention include such solid fuels as bituminous coal, sub-bituminous coal, lignite, peat, biomass and the like. The solid fuel should be in finely divided form, that is, ground to a particle size no greater than about ¼ inch with preferably at least 100% passing through a standard U.S. 40 mesh sieve. Solid fuels ground to 40–100 mesh particles have been found satisfactory. In the following specification for the sake of simplicity, the solid fuel will be referred to as coal but it should be kept in mind that the term "coal" in this respect is used in a generic sense.

The solvents used in the process of our invention should have a boiling range between about 400° and 900° F. preferably between about 400° and 800° F. and may contain considerable amounts of hydroaromatic compounds. Once the process has been on-stream for some time, a suitable boiling range portion of the liquefied coal produced during the dissolution step may be recycled thereto. However, at startup and also during the process, the solvent may comprise anthracene oil, creosote oil, a petroleum distillate such as cycle gas oil, tetralin, decalin, and/or other hydroaromatic compounds. The solvent should be present in the liquefaction zone in an amount between about 0.5 and 5 parts by weight per part of coal preferably between about 1 and 4 parts solvent per part of coal by weight. The reaction mixture is heated to a temperature between about 700° and 900° F., preferably 700° to 850° F. in a liquefaction zone which may comprise a vessel equipped with agitation. The process may be carried out batchwise or in a continuous manner. In one embodiment of the invention, the agitation may be provided by passing the mixture of finely divided coal, solvent, methanol or formaldehyde or a mixture thereof and water through an elongated heating zone having a length to diameter ratio of at least 100 and preferably at least 1000 under conditions of turbulent flow. The heating in the liquefaction zone may generally be effected under superatmospheric pressure, preferably within the range of 0 to 400 psig and still more preferably between about 10 and 400 psig.

The liquefaction of the coal takes place in the presence of internally generated hydrogen. By accomplishing the generation of hydrogen directly on the coal surface as is accomplished by the process of our invention, the slower mass transfer steps in the prior art liquefaction processes can be eliminated. One method of accomplishing this is to soak the coal in a mixture of methanol and water and then carry out the liquefaction reaction in the presence of a solvent having a boiling range between about 400° and 800° F. At temperatures above about 400° C. (752° F.) and pressures below 100 atmospheres (1500 psig) methanol decomposes to form carbon monoxide and hydrogen. Due to the possible catalytic action of some of the ingredients of the coal, the shift conversion reaction between carbon monoxide and water to produce carbon dioxide and additional hydrogen may also take place. Thus, for every mole of methanol there is a potential for producing three moles of hydrogen. This generation of hydrogen on the coal surface in the presence of a liquid solvent which provides mass transfer resistance to the desorption of hydrogen to the bulk phase, gives faster rates for liquefaction of the coal under pressures less than 400 psig while eliminating the need for hydrogen donor solvents. The methanol or formaldehyde to coal ratio should be within the range of 0.01 to 1.0 preferably between 0.1 and 1.0 and still more preferably between 0.1 and 0.5. The water to methanol or formaldehyde ratio should be within the range of 0.01 to 1.0 preferably between 0.1 and 1.0 and still more preferably between 0.2 and 0.8, all proportions being by weight.

The following experimental runs are submitted for illustrative purposes only.

The solid fuel charge to the following experimental runs was a Lake deSmet Wyoming coal ground to 40–100 mesh particles and dried in an oven at 210° F. for two hours. Its ultimate analysis is 0.4 weight percent moisture, 26.7 weight % ash, 1.21 weight percent sulfur, 49.5 weight percent carbon, 4.1 weight percent hydrogen, and 0.67 weight percent nitrogen. It has a calorific value of 8,407 BTU per pound.

The anthracene oil used in Runs 1 and 2 was a hydrogenated anthracene oil having the following analysis. Carbon 90.5 weight %, hydrogen 7.8 weight %, nitrogen 0.37 weight %, sulfur 0.004 weight % and oxygen (by difference) 1.326%. It had a specific gravity of 1.079.

| Distillation Data | °F. |
|---|---|
| IBP | 390 |
| 25% | 509 |
| 50% | 573 |
| 75% | 620 |
| EP | 731 |

The tetralin used as solvent in Runs 3 and 4 was a purified grade having a boiling point of 206° C. (403° F.).

The runs were made by charging the materials in the absence of added catalyst in the amounts shown below to the reactors which were then sealed without any external hydrogen pressure. The reactors were then heated to 800° F. by immersion in a molten salt bath and were maintained at that temperature for a period of 5 minutes which included a heating up time of about 2 minutes. During the reaction period, the reactors were shaken horizontally to achieve maximum mixing. The reactors were then quenched by immersion in a water bath. After degassing, the solid liquid contents of the reactors were transferred to Soxhlet extraction thimbles using 7 weight % solution of toluene in n-heptane. The gases were analyzed by mass spectroscopy, whereas the solid liquid mixtures was extracted with heptane, toluene and pyridine consecutively to determine the conversions of coal to heptane solubles (gases, oils and resins), toluene solubles (heptane solubles plus asphaltenes) and pyridine solubles (toluene solubles plus preasphaltenes). After pyridine extraction, the residue was ashed at 750° C. for two hours to determine the ash recovery.

Data on the six experimental runs appear below. The amounts of materials charged to the reactor are given in parts by weight.

| Run | 1 | 2 | 3 | 4 | 5 | 6 |
|---|---|---|---|---|---|---|
| Coal | 40.04 | 40.00 | 40.02 | 40.00 | 40.00 | 40.01 |
| Methanol | 8.27 | 0.0 | 8.31 | 0.0 | 8.24 | 8.33 |
| Water | 4.22 | 0.0 | 4.20 | 0.0 | 4.11 | 0.0 |
| Anthracene Oil | 80.26 | 79.92 | 0.0 | 0.0 | 0.0 | 0.0 |
| Tetralin | 0.0 | 0.0 | 79.96 | 79.97 | 0.0 | 0.0 |
| Conversions | | | | | | |
| Wt. % Coal Feed* | | | | | | |
| Solubles | | | | | | |
| Heptane | 43.3 | 38.5 | 35.3 | 33.2 | 20.0 | 18.2 |
| Toluene | 49.5 | 50.8 | 40.0 | 40.8 | 18.9 | 17.0 |
| Pyridine | 78.3 | 65.7 | 52.8 | 56.4 | 16.7 | 17.3 |
| Ash Recovery, Wt. % ash in feed coal | 98.3 | 93.6 | 97.1 | 97.4 | 101.5 | 100.5 |

*moisture and ash free

The above results indicate that the conversion of coal to pyridine solubles is the highest (78.3%) when methanol, water and anthracene oil were used. When methanol and water were not used, the pyridine conversions dropped down to 65.7%. The necessity of using an oil boiling in the range of 400° to 800° F. is indicated by comparing Run 1 with Runs 3 and 5. In Run 3, the solvent was tetralin which boils at 403° F., whereas Run 5 was made with no solvent. Both of these runs gave considerably lower conversion than Run 1. Runs 3 and 4 indicate that when the solvent has a low boiling point, most of it is vaporized during liquefaction and thus it does not offer any resistance to the desorption of hydrogen to the bulk vapor phase and the advantages of using methanol and water seem to disappear. Tetralin itself is known to be a very good hydrogen donor solvent (its hydrogen content is 9.25% as against 7.8% for anthracene oil) but because of its lower boiling point the conversions obtained using tetralin are considerably lower (52.8 and 56.4% for Runs 3 and 4 as against 78.3 and 65.7% for Runs 1 and 2) than those obtained using anthracene oil.

These reults indicate the advantages of using methanol and water as a source of hydrogen and the use of a high boiling liquid solvent boiling in the range of about 400° to 800° F. or at least not substantially vaporized under liquefaction conditions.

Similar results are obtained when formaldehyde is used in place of methanol.

Various other modifications of the invention as herein before set forth may be made without departing from the spirit and scope thereof, and therefore, only such limitations should be made as are indicated in the appended claims.

We claim:

1. A process for the liquefaction of a solid fuel which consists essentially of contacting a solid fuel in finely divided form in the presence of a solvent therefor with water and a material which can decompose to hydrogen and carbon monoxide at a temperature between about 700° and 900° F. and a pressure between about 0 and 400 psig for a period of time between about 1 minute and 120 minutes.

2. The process of claim 1 in which the material comprises methanol.

3. The process of claim 1 in which the material comprises formaldehyde.

4. The process of claim 1 in which the solvent has a boiling range of about 400° to 800° F.

5. The process of claim 1 in which the solvent to fuel weight ratio is between 0.5 and 5.0.

6. The process of claim 1 in which the material to fuel weight ratio is between about 0.01 and 1.

7. The process of claim 1 in which the solvent comprises a portion of the liquefied product.

8. The process of claim 1 in which the liquefaction reaction is carried out in the absence of added catalyst.

9. The process of claim 1 in which the liquefaction reaction is carried out in a batch wise manner.

10. The process of claim 1 in which the liquefaction reaction is carried out in a continuous manner.

* * * * *